US008544564B2

(12) United States Patent
Moore et al.

(10) Patent No.: US 8,544,564 B2
(45) Date of Patent: Oct. 1, 2013

(54) WIRELESS COMMUNICATIONS IN A DRILLING OPERATIONS ENVIRONMENT

(75) Inventors: Jeffrey L Moore, Houston, TX (US); Vimal V. Shah, Sugarland, TX (US); Wallace R. Gardner, Houston, TX (US); Donald G. Kyle, The Colony, TX (US); Malcolm Douglas McGregor, The Woodlands, TX (US); Randal Thomas Beste, Houston, TX (US); Jesse Kevin Hensarling, Cleveland, TX (US); Sergei A Sharonov, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 150 days.

(21) Appl. No.: 11/098,893

(22) Filed: Apr. 5, 2005

(65) Prior Publication Data

US 2006/0219438 A1 Oct. 5, 2006

(51) Int. Cl.
*E21B 47/12* (2012.01)

(52) U.S. Cl.
USPC ..... 175/50; 175/48

(58) Field of Classification Search
USPC ..... 175/48, 49, 50, 57; 340/853.3, 853.6; 166/250.01, 65.1, 113
See application file for complete search history.

(56) References Cited

U.S. PATENT DOCUMENTS

| | | | | | |
|---|---|---|---|---|---|
| 3,186,222 | A | * | 6/1965 | Martin | 340/853.7 |
| 3,588,804 | A | * | 6/1971 | Fort | 367/82 |
| 3,790,930 | A | * | 2/1974 | Lamel et al. | 367/82 |
| 3,876,972 | A | * | 4/1975 | Garrett | 367/82 |
| 4,057,781 | A | | 11/1977 | Scherbatskoy | |
| 4,314,365 | A | | 2/1982 | Petersen et al. | |
| 4,510,696 | A | * | 4/1985 | Roesler | 33/304 |
| 4,715,451 | A | | 12/1987 | Bseisu et al. | |
| 4,739,325 | A | * | 4/1988 | MacLeod | 340/854.4 |
| 4,965,774 | A | * | 10/1990 | Ng et al. | 367/75 |
| 4,992,997 | A | | 2/1991 | Bseisu | |
| 5,131,477 | A | | 7/1992 | Stagg et al. | |
| 5,144,298 | A | * | 9/1992 | Henneuse | 340/854.6 |
| 5,151,882 | A | | 9/1992 | Kingman | |
| 5,274,552 | A | * | 12/1993 | Milburn | 702/9 |
| 5,289,354 | A | | 2/1994 | Clayer et al. | |
| 5,293,937 | A | | 3/1994 | Schultz et al. | |
| 5,303,203 | A | | 4/1994 | Kingman | |

(Continued)

FOREIGN PATENT DOCUMENTS

| | | |
|---|---|---|
| GB | 2410512 | 8/2005 |
| GB | 2440855 B | 6/2011 |
| WO | WO-02065158 A1 | 8/2002 |
| WO | WO-2006/108000 A2 | 10/2006 |

OTHER PUBLICATIONS

"Partial International Search Report for corresponding PCT Application No. PCT/US2006/012562", (Aug. 21, 2006), 3 pgs.

(Continued)

*Primary Examiner* — David Andrews
(74) *Attorney, Agent, or Firm* — Schwegman, Lundberg & Woessner, P.A.; Bradley A. Misley

(57) ABSTRACT

An apparatus for wireless communications in a drilling operations environment can include an instrument hub that is inline with drill pipe of a drill string. The instrument hub includes a sensor to receive downhole communications from downhole. The instrument hub also includes a transmitter to wireless transmit data representative of the downhole communications to a data processor unit.

15 Claims, 6 Drawing Sheets

(56) References Cited

U.S. PATENT DOCUMENTS

| | | | | |
|---|---|---|---|---|
| 5,339,037 | A * | 8/1994 | Bonner et al. | 324/366 |
| 5,348,091 | A | 9/1994 | Tchakarov et al. | |
| 5,448,914 | A * | 9/1995 | Van Middeldorp | 73/432.1 |
| 5,458,200 | A | 10/1995 | Lagerlef et al. | |
| 5,467,083 | A | 11/1995 | McDonald et al. | |
| 5,568,448 | A | 10/1996 | Tanigushi et al. | |
| 5,579,283 | A | 11/1996 | Owens et al. | |
| 5,592,438 | A | 1/1997 | Rorden et al. | |
| 5,644,186 | A | 7/1997 | Birchak et al. | |
| 5,812,068 | A | 9/1998 | Wisler et al. | |
| 5,881,310 | A * | 3/1999 | Airhart et al. | 710/3 |
| 5,914,911 | A | 6/1999 | Babour et al. | |
| 6,002,643 | A | 12/1999 | Tchakarov et al. | |
| 6,055,213 | A | 4/2000 | Rubbo et al. | |
| 6,105,690 | A | 8/2000 | Biglin, Jr. et al. | |
| 6,137,747 | A | 10/2000 | Shah et al. | |
| 6,147,932 | A | 11/2000 | Drunheller | |
| 6,234,257 | B1 | 5/2001 | Ciglenec et al. | |
| 6,272,434 | B1 | 8/2001 | Wisler et al. | |
| 6,400,646 | B1 | 6/2002 | Shah et al. | |
| 6,434,084 | B1 | 8/2002 | Schultz | |
| 6,697,298 | B1 | 2/2004 | Dubinsky et al. | |
| 6,831,571 | B2 * | 12/2004 | Bartel | 340/854.6 |
| 6,944,547 | B2 * | 9/2005 | Womer et al. | 702/7 |
| 7,040,415 | B2 * | 5/2006 | Boyle et al. | 175/40 |
| 7,054,750 | B2 * | 5/2006 | Rodney et al. | 702/9 |
| 7,163,065 | B2 * | 1/2007 | Zhang et al. | 166/385 |
| 7,477,161 | B2 * | 1/2009 | Macpherson et al. | 340/853.3 |
| 2002/0075114 | A1 * | 6/2002 | Hall et al. | 336/192 |
| 2002/0104653 | A1 | 8/2002 | Hosie et al. | |
| 2003/0070842 | A1 | 4/2003 | Bailey et al. | |
| 2003/0137430 | A1 * | 7/2003 | Chalitsios et al. | 340/870.01 |
| 2003/0142586 | A1 | 7/2003 | Shah et al. | |
| 2003/0151977 | A1 * | 8/2003 | Shah et al. | 367/82 |
| 2004/0035608 | A1 * | 2/2004 | Meehan et al. | 175/40 |
| 2004/0047235 | A1 | 3/2004 | Kyle et al. | |
| 2004/0113808 | A1 | 6/2004 | Hall et al. | |
| 2004/0118608 | A1 * | 6/2004 | Haci et al. | 175/26 |
| 2004/0153245 | A1 * | 8/2004 | Womer et al. | 702/9 |
| 2004/0156264 | A1 * | 8/2004 | Gardner et al. | 367/81 |
| 2004/0217880 | A1 * | 11/2004 | Clark et al. | 340/854.9 |
| 2005/0001737 | A1 | 1/2005 | Baron et al. | |
| 2005/0016771 | A1 * | 1/2005 | Mayes et al. | 175/48 |
| 2005/0024231 | A1 | 2/2005 | Fincher et al. | |
| 2005/0034917 | A1 * | 2/2005 | Mathiszik et al. | 181/108 |
| 2005/0056419 | A1 | 3/2005 | Lynch et al. | |
| 2005/0087368 | A1 * | 4/2005 | Boyle et al. | 175/57 |
| 2005/0150691 | A1 * | 7/2005 | Schultz et al. | 175/57 |
| 2006/0290528 | A1 * | 12/2006 | MacPherson et al. | 340/853.1 |
| 2007/0017682 | A1 * | 1/2007 | Abrahamsen et al. | 166/379 |
| 2007/0257811 | A1 * | 11/2007 | Hall et al. | 340/854.6 |

OTHER PUBLICATIONS

Elliott, L. R., et al., "Recording Downhole Formation Data While Drilling", *Society of Petroleum Engineers—SPE 12360*, (Jul. 1985), 1231-1238 (and four pages of tables and figures).

Graff, R. L., et al., "Use of Data Center and Telecommunications in Drilling Operations and Engineering", *Society of Petroleum Engineers—SPE 14068*, (presented at the SPE 1986 International Meeting in Petroleum Engineering, Beijing, China), (1986), 589-598.

Martin, C. A., et al., "Wellsite Applications of Integrated MWD and Wellsite Data", *IADC/SPE 14721*, (presented at SPE/IADC Drilling Conference, Dallas, TX), (1986), 18 pgs.

Veneruso, A. F., et al., "Computer-Based Downhole Data Acquisition and Transmission in Well Testing", *Society of Petroleum Engineers—SPE 24728*, (1992), 695-707.

"International Search Report and Written Opinion for Application No. PCT/US2006/012562, Mailed Nov. 15, 2006", 18 Pages.

"Australian Application Serial No. 2006231549, Response filed May 13, 2010 to Examiner's First Report mailed May 28, 2009", 15 pgs.

"British Application Serial No. 0721296.2, Amendment filed Dec. 6, 2007", 6 pgs.

"British Application Serial No. 0721296.2, Office Action mailed Jan. 26, 2010", 6 pgs.

"British Application Serial No. 0721296.2, Reply filed Jul. 26, 2010 to Examination Report dated Jan. 26, 2010", 20 pgs.

"International Application Serial No. PCT/US2006/012562, International Preliminary Report on Patentability mailed Aug. 20, 2007", 16 pgs.

"Society of Petroleum Engineers, 2002 Annual Conference and Exhibition", *The Data Room*, [online]. Retrieved from the Internet: http://www.oilit.com/1_tw/2002_contents/SPE%202002%20contents.pdf, (2002), 3 pgs.

"British Application Serial No. 0721296.2, Office Action mailed Feb. 8, 2011", 4 pgs.

"British Application Serial No. 1018018.0, Office Action mailed Nov. 30, 2010", 4 pgs.

"UK Patent Application No. 1018018.0—Response Filed—mailed Jan. 21, 2011", 2.

"United Kingdom Application No. 0721296.2—Response Filed Jan. 19, 2011", 15.

"United Kingdom Application Serial No. 0721296.2 Office Action mailed Aug. 13, 2010", 7 Pgs.

Reeves, M., et al., "Intellipipe Moving Closer to Commercial Reality", (Mar./Apr. 2004).

* cited by examiner

WIRELESS COMMUNICATIONS IN A DRILLING OPERATIONS ENVIRONMENT

PRIORITY OF INVENTION

This non-provisional application claims the benefit of priority under 35 U.S.C. §119(e) to U.S. Provisional Patent Application Ser. No. 60/584,732, filed Jul. 1, 2004, which is herein incorporated by reference.

TECHNICAL FIELD

The application relates generally to communications. In particular, the application relates to a wireless communication in a drilling operations environment.

BACKGROUND

During drilling operations for extraction of hydrocarbons, a variety of communication and transmission techniques have been attempted to provide real time data from the vicinity of the bit to the surface during drilling. The use of measurements while drilling (MWD) with real time data transmission provides substantial benefits during a drilling operation. For example, monitoring of downhole conditions allows for an immediate response to potential well control problems and improves mud programs.

Measurement of parameters such as weight on bit, torque, wear and bearing condition in real time provides for more efficient drilling operations. In fact, faster penetration rates, better trip planning, reduced equipment failures, fewer delays for directional surveys, and the elimination of a need to interrupt drilling for abnormal pressure detection is achievable using MWD techniques.

Moreover, during a trip out operation, retrieval of data from the downhole tool typically requires a communications cable be connected thereto. The data rate for downloading data from the downhole tool over such cables is typically slow and requires physical contact with the tool. Additionally, a drilling rig operator must be present to connect a communications cable to the downhole tool to download data therefrom. The communications cable and connectors are often damaged by the harsh rig environment. Valuable rig time is often lost by normal cable handling as well as cable repairs. Furthermore, if the downhole tool includes a nuclear source the cable connection and data download cannot be initiated until such source is first safely removed.

BRIEF DESCRIPTION OF THE DRAWINGS

Embodiments of the invention may be best understood by referring to the following description and accompanying drawings which illustrate such embodiments. The numbering scheme for the Figures included herein are such that the leading number for a given reference number in a Figure is associated with the number of the Figure. For example, a system 100 can be located in FIG. 1. However, reference numbers are the same for those elements that are the same across different Figures. In the drawings.

DETAILED DESCRIPTION

Figure 1:
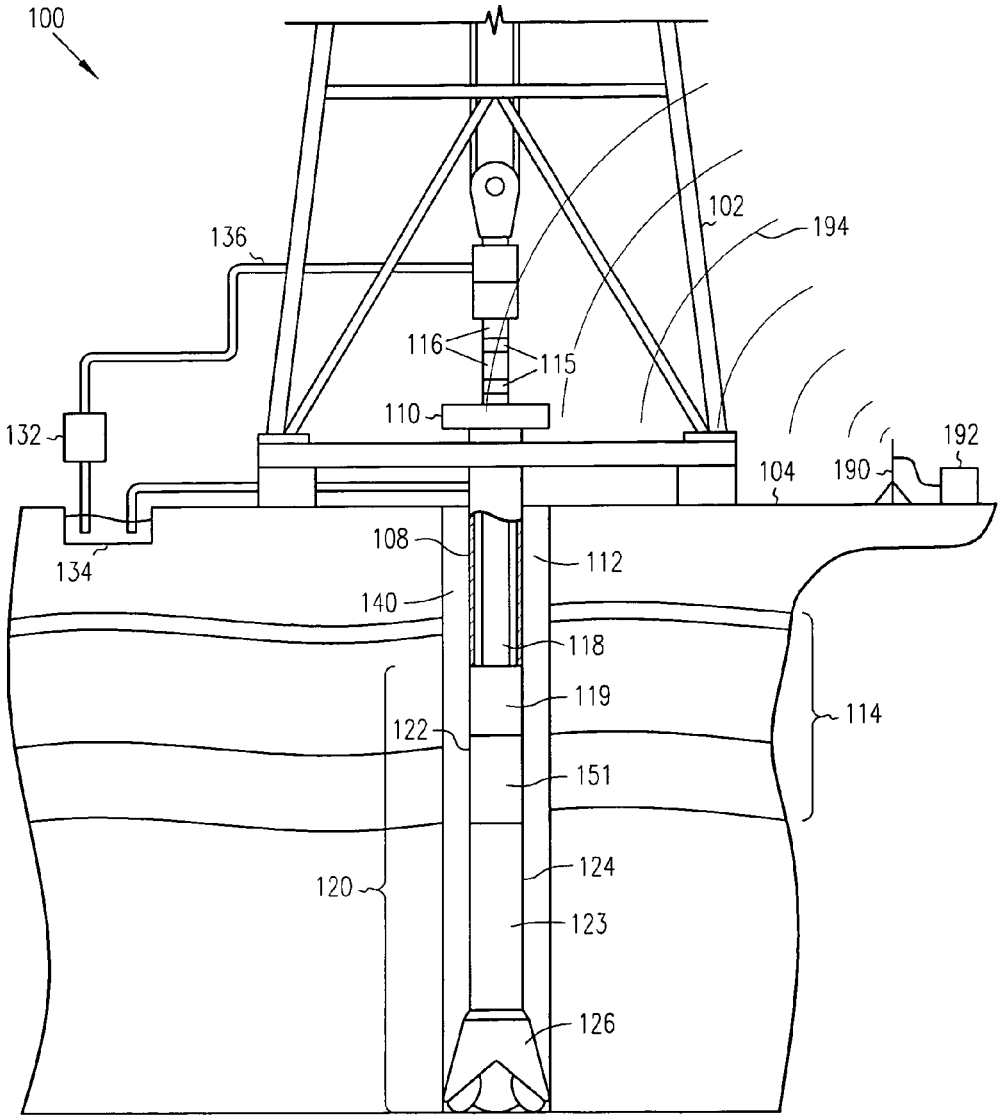
FIG. 1 illustrates a system for drilling operations, according to some embodiment of the invention.

Methods, apparatus and systems for a wireless communications in a drilling operations environment are described. In the following description, numerous specific details are set forth. However, it is understood that embodiments of the invention may be practiced without these specific details. In other instances, well-known circuits, structures and techniques have not been shown in detail in order not to obscure the understanding of this description.

While described in reference to wireless communications for drilling operations (such as Measurement While Drilling (MWD) or Logging While Drilling (LWD) drilling operations), embodiments of the invention are not so limited. For example, some embodiments may be used for communications during a logging operation using wireline tools.

Some embodiments include an instrument hub that is integrated into a drill string for drilling operations. The instrument hub may be located at or above the borehole. For example, the instrument hub may be located at or above the rig floor. The instrument hub may also include a bi-directional wireless antenna for communications with a remote ground station. In some embodiments, the instrument hub may include a number of sensors and actuators for communicating with instrumentation that is downhole. The instrument hub may also include a battery for powering the instrumentation within the instrument hub. Accordingly, some embodiments include an instrument hub integrated into the drill string, which does not require external wiring for power or communications. Therefore, some embodiments allow for communications with downhole instrumentation while drilling operations are continuing to occur. Moreover, some embodiments allow for wireless communications between the instrument hub and a remote ground station, while drilling operations continue. Therefore, the drill string may continue to rotate while these different communications are occurring. Furthermore, because the sensors and actuators within the instrument hub are integrated into the drill string, some embodiments allow for a better signal-to-noise ratio in comparison to other approaches.

Some embodiments include a downtool tool (that is part of the drill string) that includes an antenna for wireless communications with a remote ground station. The antenna may be separate from the other components in the downhole tool used to measure downhole parameters. In some embodiments, data stored in a machine-readable medium (e.g., a memory) in the downhole tool may be retrieved during a trip out operation after the antenna is in communication range of the remote ground station. Accordingly, the time of the trip out operation may be reduced because there is no need to physically connect a communication cable to the downhole tool prior to data transfer. Rather, the data transfer may commence after the antenna is in communication range of the remote ground station. Therefore, some embodiments reduce the loss of valuable drilling rig time associated with normal cable handling and repairs thereof.

FIG. 1 illustrates a system for drilling operations, according to some embodiments of the invention. A system 100 includes a drilling rig 102 located at a surface 104 of a well. The drilling rig 102 provides support for a drill string 108.

The drill string 108 penetrates a rotary table 110 for drilling a borehole 112 through subsurface formations 114. The drill string 108 includes a Kelly 116 (in the upper portion), a drill pipe 118 and a bottom hole assembly 120 (located at the lower portion of the drill pipe 118). The bottom hole assembly 120 may include a drill collar 122, a downhole tool 124 and a drill bit 126. The downhole tool 124 may be any of a number of different types of tools including Measurement While Drilling (MWD) tools, Logging While Drilling (LWD) tools, a topdrive, etc. In some embodiments, the downhole tool 124 may include an antenna to allow for wireless communications with a remote ground station. A more detail description of the downhole tool 124 is set forth below.

During drilling operations, the drill string 108 (including the Kelly 116, the drill pipe 118 and the bottom hole assembly 120) may be rotated by the rotary table 110. In addition or alternative to such rotation, the bottom hole assembly 120 may also be rotated by a motor (not shown) that is downhole. The drill collar 122 may be used to add weight to the drill bit 126. The drill collar 122 also may stiffen the bottom hole assembly 120 to allow the bottom hole assembly 120 to transfer the weight to the drill bit 126. Accordingly, this weight provided by the drill collar 122 also assists the drill bit 126 in the penetration of the surface 104 and the subsurface formations 114.

During drilling operations, a mud pump 132 may pump drilling fluid (known as "drilling mud") from a mud pit 134 through a hose 136 into the drill pipe 118 down to the drill bit 126. The drilling fluid can flow out from the drill bit 126 and return back to the surface through an annular area 140 between the drill pipe 118 and the sides of the borehole 112. The drilling fluid may then be returned to the mud pit 134, where such fluid is filtered. Accordingly, the drilling fluid can cool the drill bit 126 as well as provide for lubrication of the drill bit 126 during the drilling operation. Additionally, the drilling fluid removes the cuttings of the subsurface formations 114 created by the drill bit 126.

The drill string 108 (including the downhole tool 124) may include one to a number of different sensors 119/151, which monitor different downhole parameters. Such parameters may include the downhole temperature and pressure, the various characteristics of the subsurface formations (such as resistivity, density, porosity, etc.), the characteristics of the borehole (e.g., size, shape, etc.), etc. The drill string 108 may also include an acoustic transmitter 123 that transmits telemetry signals in the form of acoustic vibrations in the tubing wall of the drill sting 108. An instrument hub 115 is integrated into (part of the drill string 108) and coupled to the kelly 116. The instrument hub 115 is inline and functions as part of the drill pipe 118. In some embodiments, the instrument hub 115 may include transceivers for communications with downhole instrumentation. The instrument hub 115 may also includes a wireless antenna. The system 100 also includes a remote antenna 190 coupled to a remote ground station 192. The remote antenna 190 and/or the remote ground station 192 may or may not be positioned near or on the drilling rig floor. The remote ground station 192 may communicate wirelessly (194) using the remote antenna 190 with the instrument hub 115 using the wireless antenna. A more detailed description of the instrument hub 115 is set forth below.

Figure 2:
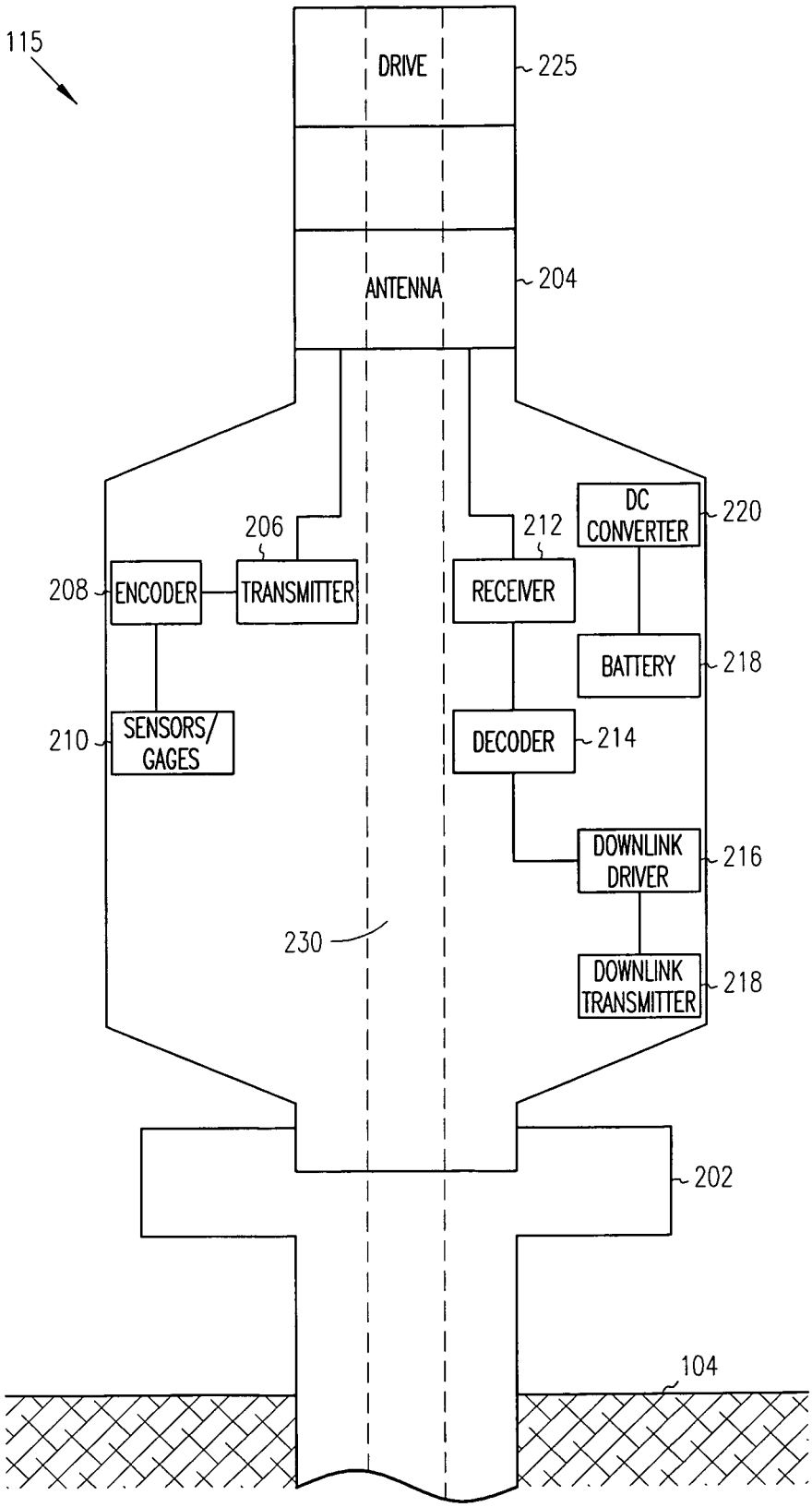
FIG. 2 illustrates an instrument hub integrated into a drill string, according to some embodiments of the invention.

FIG. 2 illustrates an instrument hub integrated into a drill string, according to some embodiments of the invention. In particular, FIG. 2 illustrates the instrument hub 115 being inline with the drill string in between the Kelly/top drive 225 and a section of the drill pipe 202. The instrument hub 115 and the drill pipe 202 include an opening 230 for the passage of drilling mud from the surface to the drill bit 126. In some embodiments, the drill pipe 202 may be wired pipe, such as Intellipipe®. Accordingly, communications between the instrument hub 115 and downhole instrumentation may be through the wire of the wired pipe.

Alternatively or in addition, communications between the instrument hub 115 and the downhole instrumentation may be based on mud pulse, acoustic communications, optical communications, etc. The instrument hub 115 may include sensors/gages 210. The sensors/gages 210 may include accelerometers to sense acoustic waves transmitted from downhole instrumentation. The accelerometers may also monitor low frequency drill string dynamics and sense generated bit noise traveling up the drill pipe. The sensors/gages 210 may include fluxgate sensors to detect magnetic fields that may be generated by instrumentation in the downhole tool 124. For example, the fluxgate sensors may be use to detect a magnetic field component of an electromagnetic field that may be representative of data communication being transmitted by instrumentation in the downhole tool 124. The sensors/gages 210 may include strain gages to monitor variations in applied torque and load. The strain gages may also monitor low frequency bending behavior of the drill pipe. In some embodiments, the sensors/gages 210 may include pressure gages to monitor mud flow pressure and to sense mud pulse telemetry pulses propagating through the annulus of the drill pipe. In some embodiments, the pressure gage reading in combination with the pressure reading on the standpipe may be processed by implementing sensor array processing techniques to increase signal to noise ratio of the mud pulses. The sensors/gages 210 may include acoustic or optical depth gages to monitor the length of the drill string 108 from the rig floor. In some embodiments, the sensors/gages 210 may include torque and load cells to monitor the weight-on-bit (WOB) and torque-on-bit (TOB). The sensors/gages 210 may include an induction coil for communications through wired pipe. The sensors/gages 210 may include an optical transceiver for communication through optical fiber from downhole.

The sensors/gages 210 may be coupled to the encoder 208. The encoder 208 may provide signal conditioning, analog-to-digital (A-to-D) conversion and encoding. For example, the encoder 208 may receive the data from the sensors/gages 210 and condition the signal. The encoder 208 may digitize and encode the conditioned signal. The sensors/gages 210 may be coupled to a transmitter 206. The transmitter 206 may be coupled to the antenna 204. In some embodiments, the antenna 204 comprises a 360° wraparound antenna. Such configurations allow the wireless transmission and reception to be directionally insensitive by providing a uniform transmission field transverse to the drill string 108.

The antenna 204 may also be coupled to a receiver 212. The receiver 212 is coupled to a decoder 214. The decoder 214 may be coupled to the downlink driver 216. The downlink driver 216 may be coupled to the downlink transmitter 218. The downlink transmitter 218 may include components to generate acoustic signals, mud pulse signals, electrical signals, optical signals, etc. for transmission of data to downhole instrumentation. For example, the downlink transmitter 218 may include a piezoelectric stack for generating an acoustic signal. The downlink transmitter 218 may include an electromechanical valve mechanism (such as an electromechanical actuator) for generating mud pulse telemetry signals. In some embodiments, the downlink transmitter 218 may include instrumentation for generating electrical signals that are transmitted through the wire of the wired pipe. The downlink transmitter 218 may also include instrumentation for generating optical signals that are transmitted through the optical cables that may be within the drill string 108.

In some embodiments, the instrument hub 115 may also include a battery 218 that is coupled to a DC (Direct Current) converter 220. The DC converter 220 may be coupled to the different components in the instrument hub 115 to supply power to these components.

Figure 3:
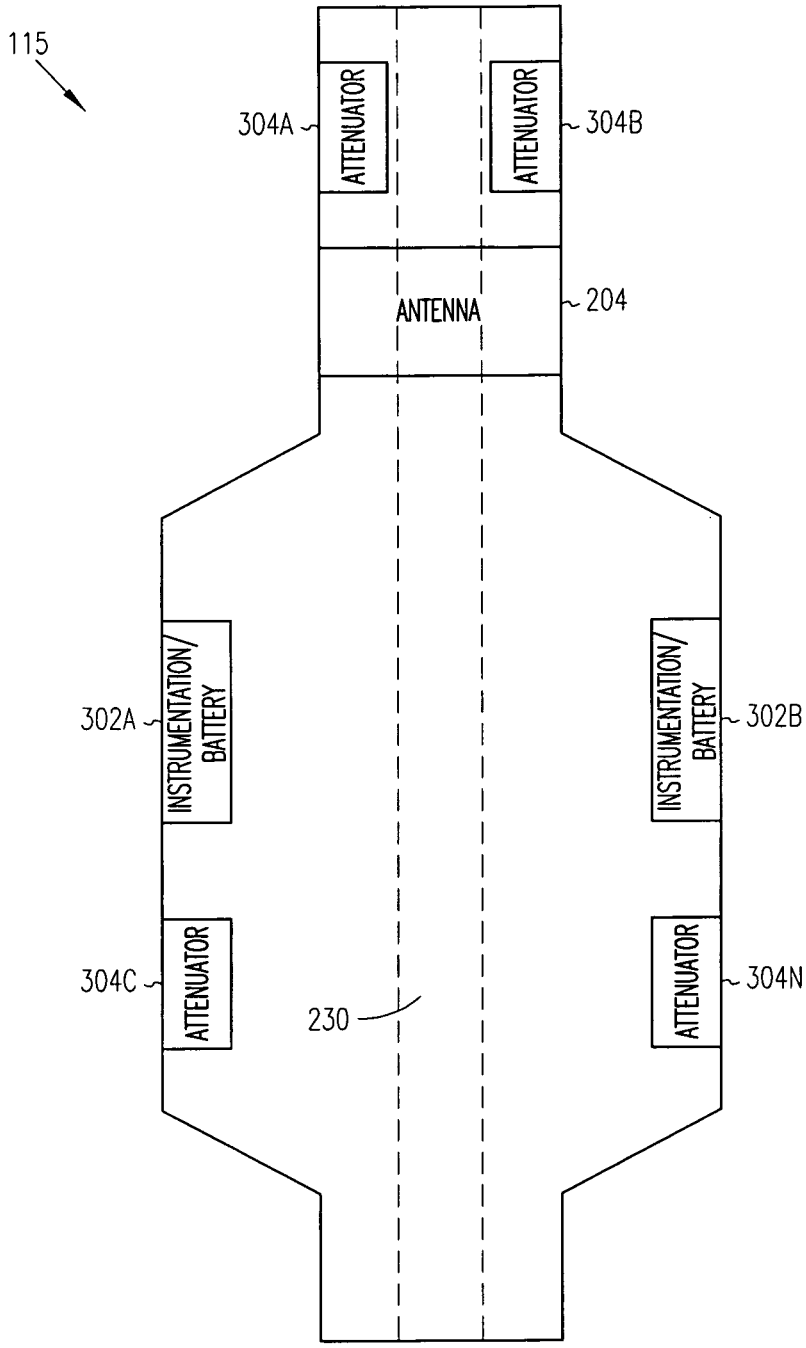
FIG. 3 illustrates an instrument hub that includes attenuators integrated into a drill string, according to some embodiments of the invention.

FIG. 3 illustrates an instrument hub that includes attenuators integrated into a drill string, according to some embodiments of the invention. In particular, FIG. 3 illustrates the instrument hub 115, according to some embodiments of the invention. The instrument hub 115 includes the antenna 204 and instrumentation/battery 302A-302B (as described above in FIG. 2). The instrument hub 115 may also include attenuators 304A-304N. The attenuators 304A-304B may reduce noise that is generated by the Kelly/top drive 225 that may interfere with the signals being received from downhole. The attenuators 304 may also reduce noise produced by the reflections of the signals (received from downhole) back into the instrument hub 115 from the Kelly/top drive 225.

Figure 4:
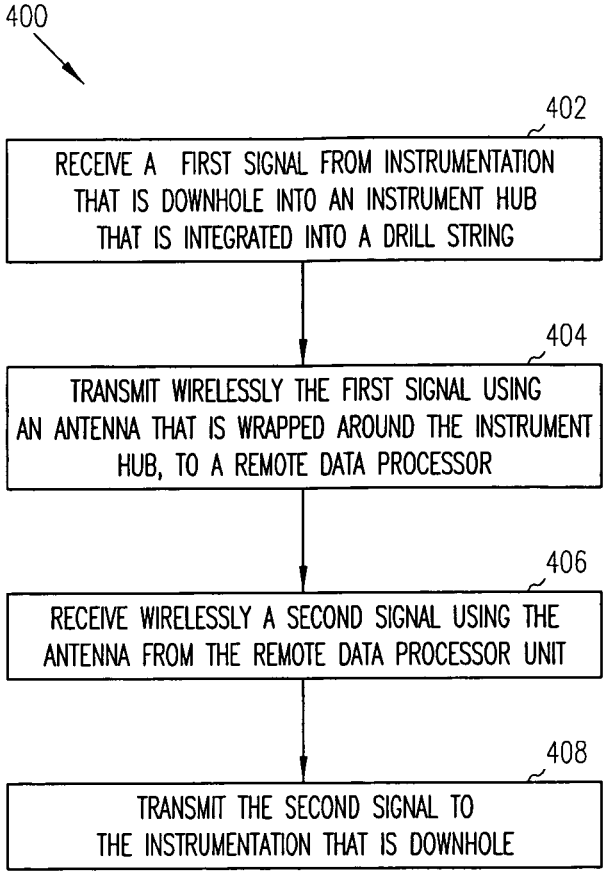
FIG. 4 illustrates a flow diagram of operations of an instrument hub, according to some embodiments of the invention.

A more detailed description of some embodiments of the operations of the instrument hub 115 is now described. In particular, FIG. 4 illustrates a flow diagram of operations of an instrument hub, according to some embodiments of the invention.

In block 402, a first signal is received from instrumentation that is downhole into an instrument hub that is integrated into a drill string. With reference to the embodiments of FIGS. 1 and 2, the instrument hub 115 may receive the first signal from the instrumentation in the downhole tool 124. For example, the instrumentation may include a piezoelectric stack that generates an acoustic signal; a mud pulser to generate mud pulses; electronics to generate electrical signals; etc. One of the sensors/gages 210 may receive the first signal. For example, an acoustic sensor may receive the acoustic signal modulated along the drill string 108. A pressure sensing device may be positioned to receive the mud pulses along the annulus. The sensors may include induction coils or optical transducers to receive an electrical or optical signal, respectively. Control continues at block 404.

In block 404, the first signal is wirelessly transmitted, using an antenna that is wrapped around the instrument hub, to a remote data processor unit. With reference to the embodiments of FIGS. 1 and 2, the encoder 208 may receive the first signal from the sensors/gages 210 and encode the first signal. The encoder 208 may encode the first signal using a number of different formats.

For example, communication between the instrument hub 115 and the remote ground station 192 may be formatted according to CDMA (Code Division Multiple Access) 2000 and WCDMA (Wideband CDMA) standards, a TDMA (Time Division Multiple Access) standard and a FDMA (Frequency Division Multiple Access) standard. The communication may also be formatted according to an Institute of Electrical and Electronics Engineers (IEEE) 802.11, 802.16, or 802.20 standard.

For more information regarding various IEEE 802.11 standards, please refer to "IEEE Standards for Information Technology—Telecommunications and Information Exchange between Systems—Local and Metropolitan Area Network—Specific Requirements—Part 11: Wireless LAN Medium Access Control (MAC) and Physical Layer (PHY), ISO/EEC 8802-11: 1999" and related amendments. For more information regarding IEEE 802.16 standards, please refer to "IEEE Standard for Local and Metropolitan Area Networks—Part 16: Air Interface for Fixed Broadband Wireless Access Systems, IEEE 802.16-2001", as well as related amendments and standards, including "Medium Access Control Modifications and Additional Physical Layer Specifications for 2-11 GHz, IEEE 802.16a-2003". For more information regarding IEEE 802.20 standards, please refer to "IEEE Standard for Local and Metropolitan Area Networks—Part 20: Standard Air Interface for Mobile Broadband Wireless Access Systems Supporting Vehicular Mobility—Physical and Media Access Control Layer Specification, IEEE 802.20 PD-02, 2002", as well as related amendments and documents, including "Mobile Broadband Wireless Access Systems Access Systems "Five Criteria" Vehicular Mobility, IEEE 802.20 PD-03, 2002.

For more information regarding WCDMA standards, please refer to the various 3rd Generation Partnership Project (3GPP) specifications, including "IMT-2000 DS-CDMA System," ARIB STD-T63 Ver. 1.4303.100 (Draft), Association of Radio Industries and Businesses (ARIB), 2002. For more information regarding CDMA 2000 standards, please refer to the various 3rd Generation Partnership Project 2 (3GPP2) specifications, including "Physical Layer Standard for CDMA2000 Spread Spectrum Systems," 3GPP2 C.S0002-D, Ver. 1.0, Rev. D, 2004.

The communication between the instrument hub 115 and the remote ground station 192 may be based on a number of different spread spectrum techniques. The spread spectrum techniques may include frequency hopping spread spectrum (FHSS), direct sequence spread spectrum (DSSS), orthogonal frequency domain multiplexing (OFDM), or multiple-in multiple-out (MIMO) specifications (i.e., multiple antenna), for example.

The transmitter 206 may receive the encoded signal from the encoder 208 and wirelessly transmit the encoded signal through the antenna 204 to the remote ground station 192. Control continues at block 406.

In block 406, a second signal is wirelessly received using the antenna that is wrapped around the instrument hub 115 from the remote data processor unit. With reference to the embodiments of FIGS. 1 and 2, the receiver 212 may wirelessly receive through the antenna 204 the second signal from the remote ground station 192 (through the antenna 190). The receiver 212 may demodulate the second signal. The decoder 214 may receive and decode the demodulated signal. The decoder 214 may decode the demodulated signal based on the communication format used for communications between the antenna 214 and the remote antenna 190 (as described above). Control continues at block 408.

In block 408, the second signal is transmitted to the instrumentation downhole. With reference to the embodiments of FIGS. 1 and 2, the downlink driver 216 may receive the decoded signal from the decoder 214. The downlink driver 216 may control the downlink transmitter 218 to generate a signal (representative of data in the second signal) that is transmitted to the instrumentation in the downhole tool 124. For example, the downlink transmitter 218 may be a piezoelectric stack that generates an acoustic signal that is modulated along the drill string 108. The downlink transmitter 218 may be a mud pulser that generates mud pulses within the drilling mud flowing through the opening 230. The downlink transmitter 218 may be a circuit to generate an electrical signal along wire in the wire pipe of the drill string 108. The downlink transmitter 218 may also be a circuit to generate an optical signal along an optical transmission medium (such as a fiber optic line, etc.).

While the operations of the flow diagram 400 are shown in a given order, embodiments are not so limited. For example, the operations may be performed simultaneously in part or in a different order. As described, there is no requirement to stop the drilling operations (including the rotation of the drill string 108) while the operations of the flow diagram 400 are being performed. Accordingly, embodiments may allow for the drilling operations to be performed more quickly and accurately.

Figure 5:
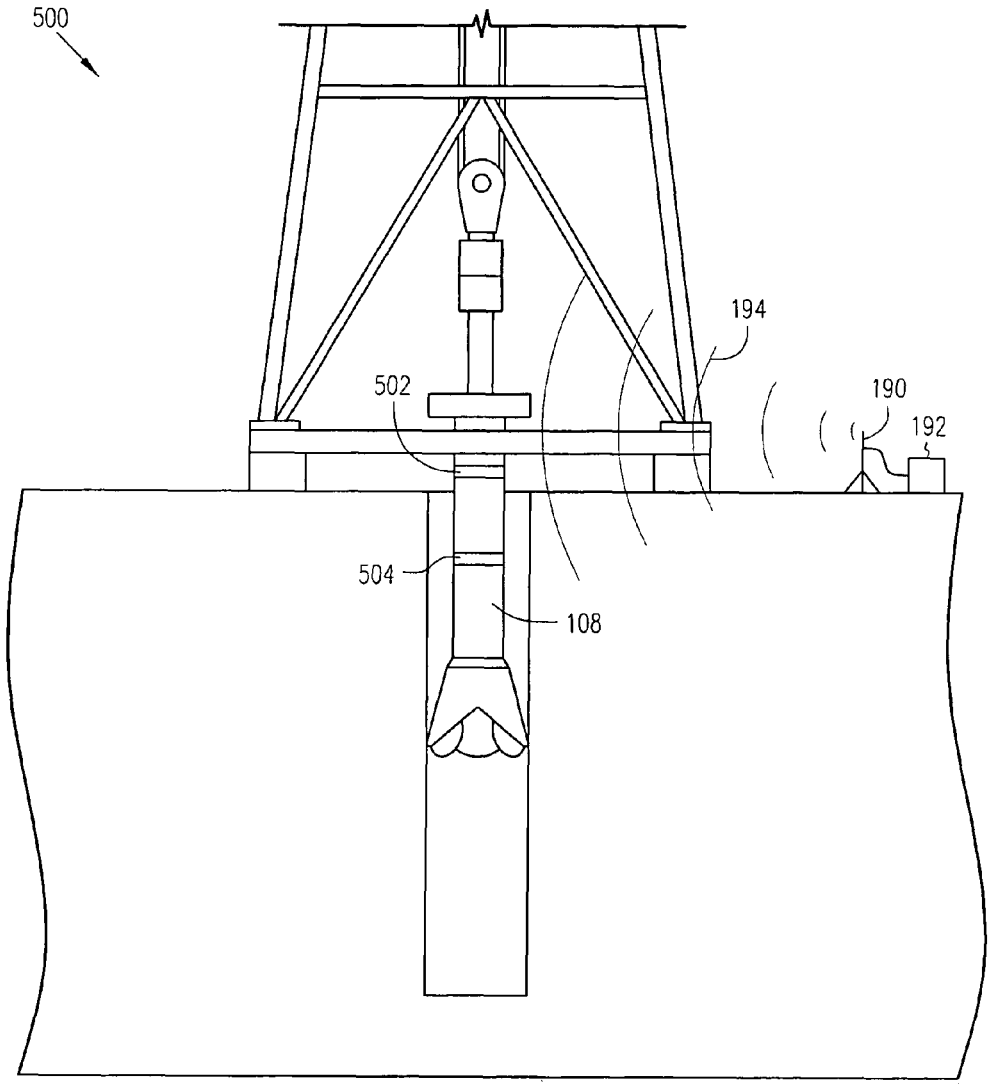
FIG. 5 illustrates a downhole tool having a wireless transceiver, according to some embodiments of the invention.

FIG. 5 illustrates a downhole tool that includes a wireless transceiver and is part of a system for drilling operations, according to some embodiments of the invention. In particular, FIG. 5 illustrates the downhole tool 124 within a system 500 (that is similar to the system 100 of FIG. 1), according to some embodiments of the invention. As shown, the drill string 108 that includes the downhole tool 124 and the drill bit 126 is being retrieved from downhole during a trip out operation.

The downhole tool 124 includes an antenna 502 and a sensor 504. The sensor 504 may be representative of one to a number of sensors that may measure a number of different parameters, such as the downhole temperature and pressure, the various characteristics of the subsurface formations (such as resistivity, density, porosity, etc.), the characteristics of the borehole (e.g., size, shape, etc.), etc. The antenna 502 may be used for wireless communications with the remote ground station 192 (shown in FIG. 1), during a trip operation of the drill string 108. In some embodiments, the antenna 502 is not used for measuring downhole parameters.

Communication between the antenna 502 on the downhole tool 124 and the remote ground station 192 may be formatted according to CDMA (Code Division Multiple Access) 2000 and WCDMA (Wideband CDMA) standards, a TDMA (Time Division Multiple Access) standard and a FDMA (Frequency Division Multiple Access) standard. The communication may also be formatted according to an Institute of Electrical and Electronics Engineers (IEEE) 802.11, 802.16, or 802.20 standard. The communication between the antenna 502 and the remote ground station 192 may be based on a number of different spread spectrum techniques. The spread spectrum techniques may include frequency hopping spread spectrum (FHSS), direct sequence spread spectrum (DSSS), orthogonal frequency domain multiplexing (OFDM), or multiple-in multiple-out (MIMO) specifications (i.e., multiple antenna), for example.

Figure 6:
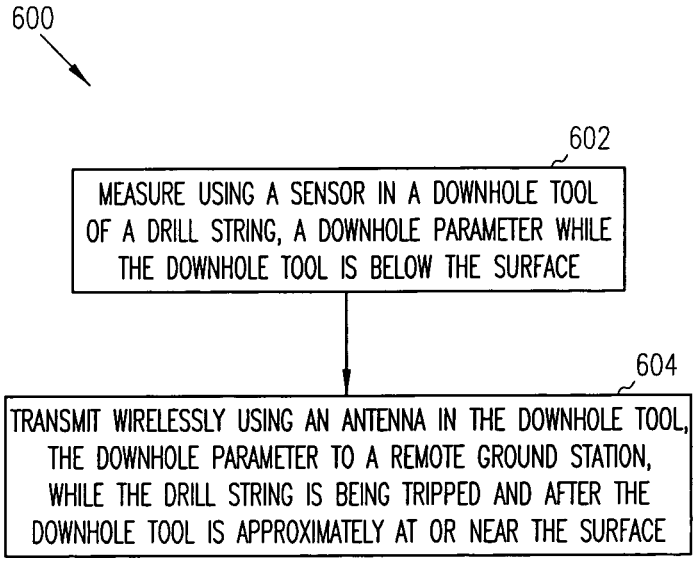
FIG. 6 illustrates a flow diagram of operations of a downhole tool, according to some embodiments of the invention.

A more detailed description of some embodiments of the operations of the downhole tool 124 is now described. In particular, FIG. 6 illustrates a flow diagram of operations of a downhole tool, according to some embodiments of the invention.

In block 602 of a flow diagram 600, a downhole parameter is measured, using a sensor in a downhole tool of a drill string, while the downhole tool is below the surface. With reference to the embodiments of FIGS. 1 and 5, the sensor 504 may measure a number of downhole parameters during a Logging While Drilling (LWD) operation. These measurements may be stored in a machine-readable medium within the downhole tool 124. Control continues at block 604.

In block 604, the downhole parameter is transmitted wirelessly, using an antenna in the downhole tool, to a remote ground station, during a trip out operation of the drill string and after the downhole tool is approximately at or near the surface. With reference to the embodiments of FIGS. 1 and 5, the antenna 502 may perform this wireless communication of the downhole parameter to the remote ground station 192 (using the antenna 190). For example, in some embodiments, the remote ground station 192 may commence a wireless pinging operation after a trip out operation begins. Such a pinging operation may initiated by a drilling rig operator. After the antenna 502 receives this ping and transmits a pong in return, the antenna 502 may commence wireless communications of at least part of the data stored in the machine-readable medium (e.g., memory) of the downhole tool 124. Accordingly, depending on the communication range, this wireless communication may commence while the downhole tool 124 is still below the surface. In some embodiments, the downhole tool 124 may include instrumentation to detect the dielectric constant of air. Accordingly, after this detection of air has occurred during the trip out operation, the antenna 502 may commence the wireless communication. For example, the detection of air may occur after the downhole tool is above the surface of the earth.

In the description, numerous specific details such as logic implementations, opcodes, means to specify operands, resource partitioning/sharing/duplication implementations, types and interrelationships of system components, and logic partitioning/integration choices are set forth in order to provide a more thorough understanding of the present invention. It will be appreciated, however, by one skilled in the art that embodiments of the invention may be practiced without such specific details. In other instances, control structures, gate level circuits and full software instruction sequences have not been shown in detail in order not to obscure the embodiments of the invention. Those of ordinary skill in the art, with the included descriptions will be able to implement appropriate functionality without undue experimentation.

References in the specification to "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

A number of figures show block diagrams of systems and apparatus for wireless communications in a drilling operations environment, in accordance with some embodiments of the invention. A number of figures show flow diagrams illustrating operations for wireless communications in a drilling operations environment, in accordance with some embodiments of the invention. The operations of the flow diagrams are described with references to the systems/apparatus shown in the block diagrams. However, it should be understood that the operations of the flow diagrams could be performed by embodiments of systems and apparatus other than those discussed with reference to the block diagrams, and embodiments discussed with reference to the systems/apparatus could perform operations different than those discussed with reference to the flow diagrams.

In view of the wide variety of permutations to the embodiments described herein, this detailed description is intended to be illustrative only, and should not be taken as limiting the scope of the invention. What is claimed as the invention, therefore, is all such modifications as may come within the scope and spirit of the following claims and equivalents thereto. Therefore, the specification and drawings are to be regarded in an illustrative rather than a restrictive sense.

What is claimed is:

1. An apparatus comprising an instrument hub that is inline with the drill pipe of a drill string and forms part of the drill string, the instrument hub being located at or above the surface of the Earth, wherein the instrument hub comprises:

an elongate hub body having a tubular wall that is coaxially coupled at its opposite ends to a driven drill string component and an adjacent drill pipe section respectively, to transmit torque and rotation from the driven drill string component to the adjacent drill pipe section via the tubular wall when the driven drill string component is rotated;

a fluid passage that extends lengthwise along the hub body, the fluid passage being in fluid flow communication at its opposite ends with respective openings in the driven drill string component and the adjacent drill pipe section to enable conveyance of drilling fluid from the driven drill string component to the adjacent drill pipe section through the instrument hub towards a drill bit positioned at a downhole end of the drill string;

a wireless transmitter on the hub body to wirelessly transmit data representative of downhole communications to a data processor unit located above the surface of the Earth, while the drill string is in rotation;

an antenna on the hub body to receive data processor communications from the data processor unit located above the surface of the Earth;

instrumentation housed by the hub body to provide a wired pipe communications channel between the hub and downhole instrumentation in the drill string; and instrumentation housed by the tubular wall of the hub body to provide an additional communications channel between the hub and the downhole instrumentation, wherein the additional communications channel carries signals selected from the group consisting essentially of: mud pulse signals, acoustic signals, and optical signals.

2. The apparatus of claim 1, further comprising a sensor associated with the hub, and wherein the sensor includes an accelerometer and a fluxgate.

3. The apparatus of claim 2, wherein the instrument hub further comprises a means for supplying power to the sensor and the antenna.

4. The apparatus of claim 1, wherein the downhole instrumentation includes a downhole tool including an antenna to communicate directly from the antenna in the downhole tool the data processor unit located above the surface of the Earth, when the downhole tool is proximate the Earth's surface.

5. The apparatus according to claim 1, wherein the antenna comprises a wraparound antenna.

6. The apparatus according to claim 1, wherein the instrumentation to provide the additional communications channel is configured such that the additional communications channel is bi-directional.

7. The apparatus according to claim 1, wherein the instrumentation to provide the additional communications channel includes an acoustic downlink transmitter to transmit telemetry signals in the form of acoustic vibrations in a tubing wall of the drill string.

8. The apparatus according to claim 1, wherein the instrumentation to provide the additional communications channel includes a mud pulse downlink transmitter to generate mud pulse telemetry signals.

9. The apparatus of claim 1, wherein the driven drill string component is a Kelly, the instrument hub being located in the drill string immediately below the Kelly.

10. The apparatus of claim 1, wherein the instrument hub further comprises one or more attenuators to reduce noise generated by a Kelly or top drive during driven rotation of the drill string, to facilitate communication via the additional communications channel by the transmission of acoustic signals during driven rotation of the drill string.

11. A method of communicating with downhole instrumentation in a drill string while in an Earth borehole, the method comprising:

connecting an instrument hub in the drill string such that the instrument hub is inline with drill pipe of the drill string and forms part of the drill string, the instrument hub being located at or above the surface of the Earth, the instrument hub comprising an elongate hub body having a tubular wall that is coaxially coupled at its opposite ends to a driven drill string component and an adjacent drill pipe section respectively, to transmit torque and rotation from the driven drill string component to the adjacent drill pipe section via the tubular wall when the driven drill string component is rotated, a fluid passage that extends lengthwise along the hub body, the fluid passage being in fluid flow communication at its opposite ends with respective openings in the driven drill string component and the adjacent drill pipe section to enable conveyance of drilling fluid from the driven drill string component to the adjacent drill pipe section through the instrument hub towards a drill bit positioned at a downhole end of drill string, and a transmitter and antenna configured to establish wireless communications with a remote ground station;

establishing first and second communication channels between the instrument hub and the downhole instrumentation by use, at least in part, of instrumentation housed by the tubular wall of the hub body, wherein, the first communication channel comprises electrical communications carried through wired pipe, and the second communication channel carries at least one type of signal selected from the group consisting essentially of mud pulse signals, acoustic signals and optical signals;

wirelessly communicating data between the instrument hub and the remote ground station; and communicating data between the instrument hub and the downhole instrumentation using at least one of the first and second communication channels.

12. A method of communicating data between a remote ground location and downhole instrumentation, comprising the acts of:

establishing a wireless communication channel between the remote ground location and an instrument hub located in a surface portion of a drill string which includes the downhole instrumentation, wherein the instrument hub includes a downlink transmitter that is, configured to generate electrical signals for transmission through wire of wired pipe, and configured to generate signals for transmission in at least one of the following forms: as acoustic signals through the drill string, as mud pulse signals through a fluid column, or as optical signals through an optical cable;

wirelessly communicating data between the instrument hub and the remote ground location; and communicating data between the instrument hub and the downhole instrumentation through use of signals generated by the downlink transmitter.

13. The method of claim 12, wherein the data is communicated between the instrument hub and the downhole instrumentation through use of wires in the wired pipe.

14. The method of claim 12, wherein the instrument hub further comprises a transmitter and a receiver coupled to an antenna and wherein the wireless communication channel between the surface location and the downhole instrumentation is established through use of such transmitter, receiver and antenna.

15. The method of claim 12, wherein the downhole instrumentation includes a downhole tool including an antenna, and wherein the method further comprises the act of wirelessly communicating directly from the antenna in the downhole tool to the surface location when the downhole tool is proximate the Earth's surface.

* * * * *